US009114608B2

(12) United States Patent
Saitou

(10) Patent No.: US 9,114,608 B2
(45) Date of Patent: Aug. 25, 2015

(54) IMAGE FORMATION APPARATUS

(71) Applicant: RISO KAGAKU CORPORATION, Tokyo (JP)

(72) Inventor: Mamoru Saitou, Ibaraki-ken (JP)

(73) Assignee: RISO KAGAKU CORPORATION, Tokyo (JP)

( * ) Notice: Subject to any disclaimer, the term of this patent is extended or adjusted under 35 U.S.C. 154(b) by 7 days.

(21) Appl. No.: 13/909,660

(22) Filed: Jun. 4, 2013

(65) Prior Publication Data

US 2013/0335470 A1 Dec. 19, 2013

(30) Foreign Application Priority Data

Jun. 19, 2012 (JP) ..... 2012-137695

(51) Int. Cl.
*B41J 2/045* (2006.01)

(52) U.S. Cl.
CPC ..... *B41J 2/04573* (2013.01); *B41J 2/0456* (2013.01); *B41J 2/04526* (2013.01); *B41J 2/04581* (2013.01)

(58) Field of Classification Search
CPC .. B41J 2/04526; B41J 2/0456; B41J 2/04561; B41J 2/01; B41J 2/045–2/04598; B41J 2/38; B41J 2/393; B41J 2/029; B41J 2/3935
USPC ..... 347/74, 77, 78, 82, 14
See application file for complete search history.

(56) References Cited

U.S. PATENT DOCUMENTS

| | | | | |
|---|---|---|---|---|
| 2004/0070638 | A1* | 4/2004 | Takahashi et al. | 347/12 |
| 2004/0189750 | A1* | 9/2004 | Miura et al. | 347/52 |
| 2005/0270317 | A1* | 12/2005 | Gao et al. | 347/8 |
| 2010/0188450 | A1* | 7/2010 | Fujii | 347/10 |
| 2011/0242170 | A1* | 10/2011 | Link et al. | 347/10 |

FOREIGN PATENT DOCUMENTS

JP 2010-173178 A 8/2010

* cited by examiner

*Primary Examiner* — Geoffrey Mruk
*Assistant Examiner* — Scott A Richmond
(74) *Attorney, Agent, or Firm* — Greenblum & Bernstein P.L.C.

(57) ABSTRACT

Included are: a storage unit configured to store profile data in which the amount of landing deviation and the ejection frequency representing the number of ejections of ink droplets per unit time are associated with each other; a correction judgment unit configured to determine whether to allow ejection timing control in print processing by selecting 30 dots as a unit line in an image, adding up a total volume of ink ejected to the unit line, and comparing the total volume of ejected ink with a predetermined threshold; and an ejection control unit configured to obtain the ejection frequency for ejecting ink at a predetermined time interval, from the total volume of ink ejected in the unit line, calculate the amount of landing deviation from the ejection frequency, and control the ejection timing in accordance with the calculated amount of landing deviation.

6 Claims, 13 Drawing Sheets

FIG. 6

| FREQUENCY [Hz] | AMOUNT OF LANDING DEVIATION [μm] | |
|---|---|---|
| | HEAD GAP | |
| | CASE OF 1.6mm | CASE OF 3.0mm |
| 150KHz | 18.65 | 87.69 |
| ⋮ | ⋮ | ⋮ |
| 100Hz | 19.13 | 89.96 |
| ⋮ | ⋮ | ⋮ |
| 1Hz | 20.73 | 98.91 |

IMAGE FORMATION APPARATUS

BACKGROUND OF THE INVENTION

1. Field of the Invention

The present invention relates to an image formation apparatus for a printing machine, such as an inkjet image formation apparatus, configured to eject ink onto and thereby form an image on a print sheet being conveyed along a conveyance path.

2. Description of the Related Art

Heretofore, there have been line-type inkjet recording apparatuses as a type of image formation apparatuses. In such a line-type inkjet recording apparatus, a long recording head (line-type long recording head) is used in which ink ejection nozzles are arranged in an array which is as wide as or wider than the width of a print area. Without moving the recording head, the line-type inkjet recording apparatus forms an image by ejecting ink droplets from nozzles of the ink heads onto a recording medium below the ink heads while moving and conveying the recording medium relative to the recording head in a direction crossing the nozzle arrangement direction.

As shown in FIG. 16A, an airstream W1 (hereinafter called a conveyance airstream) flowing from upstream to downstream in a conveyance direction of a recording medium is generated when the recording medium is conveyed at a position just below the recording head. Accordingly, in a noncontact printing method in which ink droplets 20 are ejected onto a print sheet 10 from a nozzle 121 of an ink head 120, the ink droplets 20 are drifted to a downstream side in the conveyance direction of the print sheet 10 under the influence of the conveyance airstream W1, and attached to the print sheet 10 at positions deviated from their intended trajectory. This is so-called landing deviation, and causes deterioration in image quality.

For example, Patent Document 1 copes with such a problem. In the technique of Patent Document 1, when ink droplets are ejected while a recording medium and an ink head having multiple nozzles are moved relative to each other in a direction crossing a nozzle arrangement direction, the ejection is controlled by increasing the ejection speed for a smaller size of droplets. This suppresses landing deviation of ink droplets attributable to the conveyance airstream.

[Patent Document 1] Japanese Patent Application Publication No. 2010-173178

SUMMARY OF THE INVENTION

In addition to the conveyance airstream W1, as shown in FIG. 16B, an airstream W2 (hereinafter called a self-produced airstream) flowing from the ink head 120 toward the recording medium is generated at the position right below the ink head 120 when the ink droplets 20 are ejected from the nozzle 121.

The self-produced airstream W2 by the ink droplets is generated constantly, for example, when a maximum number of ink droplets are ejected from a nozzle corresponding to pixels present in a solid area. In particular, when the nozzle ejects the maximum number of droplets consecutively to pixels arranged in a sub-scanning direction (sheet conveyance direction), the generation of the self-produced airstream W2 is remarkably constant. Flowing vertically downward, the self-produced airstream W2 reduces the influence of the conveyance airstream W1 and thus reduces the amount of landing deviation of the ink droplets 20.

On the other hand, in the case of a single-shot ejection where one ink droplet is ejected to every five pixels, for example, the generation of the self-produced airstream W2 is not constant. As a result, the ejected ink droplet is largely affected by the conveyance airstream W1 and drifted farther away, increasing the amount of landing deviation.

In this way, the amount of landing deviation by which the ink droplet is drifted by the conveyance airstream W1 varies depending on a time interval between consecutive ink droplet ejections. Accordingly, using only the technique as disclosed in Patent Document 1 with uniform control to increase the ejection speed for a smaller size of ink droplets cannot resolve the landing deviation of ink droplets and cannot prevent image quality degradation.

The present invention has been made in view of the foregoing points, and aims to provide an image formation apparatus which is capable of improving the landing position accuracy and forming a good image free from landing deviation by resolving the influence of the conveyance airstream and the self-produced airstream which are generated under each ink head when ink droplets are ejected from nozzles onto a recording medium being conveyed.

For the purpose of solving the aforementioned problems, an image formation apparatus of the present invention is an image formation apparatus (for example, an inkjet recording apparatus 100 shown in FIG. 1) configured to control timing of ink ejection from nozzles (for example, nozzles 121 shown in FIG. 4) of an ink head (for example, an ink head 120 shown in FIG. 1), when an image is formed by ejecting ink from each nozzle onto a recording medium (for example, a print sheet 10 shown in FIG. 2) being conveyed on a conveyance path (for example, a platen belt 160 shown in FIG. 1), to cope with a conveyance airstream generated by the conveyance of the recording medium. The image formation apparatus is characterized by including an adjustment unit (for example, an ejection control unit 333*b* shown in FIG. 5) configured to adjust the content of the ejection timing control on the basis of a self-produced airstream rate which is calculated based on a volume of ink ejected from the nozzle per unit time and indicates a generation rate of a self-produced airstream to cause the ink ejected from the nozzle to go straight against the conveyance airstream (for example, an estimated ejection frequency x representing the number of times of ejection of ink from the nozzles per unit time, and a correction coefficient $\alpha$).

According to the above invention, the conveyance airstream flowing from upstream to downstream in the conveyance direction is generated between the nozzle and the recording medium (conveyance path) in response to the conveyance of the recording medium. In the meantime, as the volume of ink ejected from the nozzle per unit time increases, the self-produced airstream flowing in the ink ejection direction is generated between the nozzle and the recording medium (conveyance path). The degree at which the self-produced airstream causes the ink ejected from the nozzle to go straight against the conveyance airstream increases as the volume of ink ejected from the nozzle per unit time increases. The content of adjustment to the ejection timing control is determined based on the self-produced airstream rate indicating the generation rate of the self-produced airstream, and the content of the ejection timing control is adjusted using the adjustment content thus determined.

Thus, it is possible to adjust the ink ejection timing control on the nozzle while taking into consideration how much the self-produced airstream flowing in the ink ejection direction reduces the landing deviation of ink due to the conveyance airstream in accordance with the generation rate of the self-produced airstream. Thereby, the landing position accuracy can be improved, and a good image free from landing deviation can be formed.

The image formation apparatus of the present invention is characterized by further including: a storage unit (for example, a storage unit 334 shown in FIG. 5) configured to store profile data (for example, profile data shown in FIG. 6) in which the number of ink ejections from the nozzle per unit time is associated with an amount of landing deviation of ink on the recording medium; and a judgment unit (for example, a correction judgment unit 333*c* shown in FIG. 5) configured to judge whether or not the adjustment to the ejection timing control is needed, on the basis of a result of comparison between the volume of ink ejected from the nozzle per unit time and an ink ejection volume threshold corresponding to the self-produced airstream rate, and is characterized in that, in the case where the judgment unit judges that the adjustment to the ejection timing control on the nozzle is needed, the adjustment unit calculates the number of ink ejections from the nozzle per unit time from the volume of ink ejected from the nozzle per unit time, determines an amount of landing deviation of ink corresponding to the calculated number of ink ejections on the basis of the profile data, and adjusts the content of the ejection timing control using an adjustment content determined based on the self-produced airstream rate corresponding to the determined amount of landing deviation.

According to the above aspect, when the volume of ink ejected from the nozzle per unit time exceeds the ink ejection volume threshold corresponding to the self-produced airstream rate, the number of ink ejections from the nozzle per unit time is calculated from the volume of ink ejected from the nozzle per unit time, and the amount of landing deviation of ink corresponding to the calculated number of ink ejections is obtained from the profile data. Then, the ink ejection timing control on the nozzle to cope with the conveyance airstream is adjusted using the adjustment content corresponding to the amount of landing deviation thus obtained.

Thus, it is possible to adjust the ink ejection timing control on the nozzle while taking into consideration how much the self-produced airstream flowing in the ink ejection direction reduces the landing deviation of ink due to the conveyance airstream in the case where the self-produced airstream is generated constantly. Thereby, the landing position accuracy can be improved and a good image free from landing deviation can be formed.

The image formation apparatus of the present invention is characterized in that the judgment judges: whether or not the nozzle has ejected at least one drop of ink to each of a predetermined number of pixels consecutively located on the recording medium at a position downstream of the nozzle in a conveyance direction of the recording medium, as the result of comparison between the volume of ink ejected for the past predetermined period of time and the threshold; and judges that the adjustment to the ejection timing control on the nozzle is needed if judging that the nozzle has ejected at least one drop of ink to each of the pixels.

According to the above aspect, in the case where at least one drop of ink is ejected to each of the predetermined number of consecutive pixels, the self-produced airstream can be expected to be generated constantly by the consecutive ejection of ink for the predetermined number of pixels. Accordingly, the amount of landing deviation of ink is determined based on an average number of ink ejections calculated from the volume of ink ejected for the past predetermined period of time, and the ejection timing control is adjusted using the adjustment content corresponding to the amount of landing deviation thus determined. Thereby, it is possible to adjust the ink ejection timing control on the nozzle while taking into consideration the amount of change in the amount of landing deviation of ink due to the self-produced airstream.

In addition, the image formation apparatus of the present invention is characterized by further including: a sheet type acquisition unit (for example, a sheet type acquisition unit 335 shown in FIG. 5) configured to acquire information on a thickness of the recording medium; and a drive control unit (for example, a head gap control unit 332*a* shown in FIG. 5) configured to change a distance between the conveyance path and an ejection surface of the nozzle on the basis of the information on the thickness acquired by the sheet type acquisition unit, and is characterized in that: the storage unit stores a plurality of the profile data corresponding to the distance between the conveyance path and an ejection surface of the nozzle; and the adjustment unit adjusts the ejection timing control in accordance with the distance changed by the drive control unit.

According to the above invention, even when the clearance between the conveyance belt and the ejection surface of the ink head increases, the adjustment content on the ejection timing control is corrected in accordance with the clearance. Thereby, it is possible to correct the landing position appropriately, and to provide a good image free from landing deviation even when the self-produced airstream changes due to the head gap.

Moreover, the image formation apparatus according to the present invention is characterized by further including a suction unit configured to suck the recording medium to the conveyance path, and is characterized in that, in the case where the nozzle is located in an area within a predetermined distance from any of a leading end (for example, a leading end area A1 shown in FIG. 12) and a trailing end (for example, a trailing end area A2 shown in FIG. 12) of the recording medium, the adjustment unit adjusts the ejection timing control in accordance with an airstream caused by the suction unit.

According to the above invention, in the leading end and the trailing end of the print sheet where the landing deviation is likely to be influenced by the airstream caused by the suction unit, the ejection timing control can be adjusted in accordance with the airstream. Thereby, the landing position accuracy can be improved and a good image free from landing deviation can be provided.

BRIEF DESCRIPTION OF THE DRAWINGS

FIG. 6 is an explanation diagram showing profile data on the amount of landing deviation with respect to the ink ejection frequency stored in a storage unit of FIG. 5.

DESCRIPTION OF THE PREFERRED EMBODIMENTS (First Embodiment)

Embodiments of an image formation apparatus according to the present invention are described in detail below with reference to the drawings.

(Overall Configuration of Inkjet Recording Apparatus)

Figure 1:
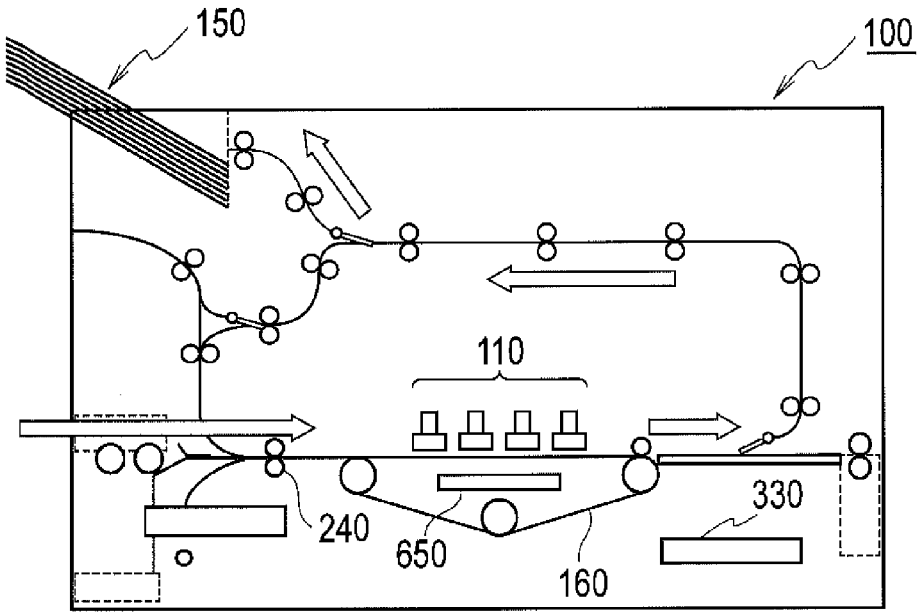
FIG. 1 is a schematic cross-sectional diagram showing an internal configuration of an inkjet recording apparatus according to a first embodiment of the present invention.
Figure 2:
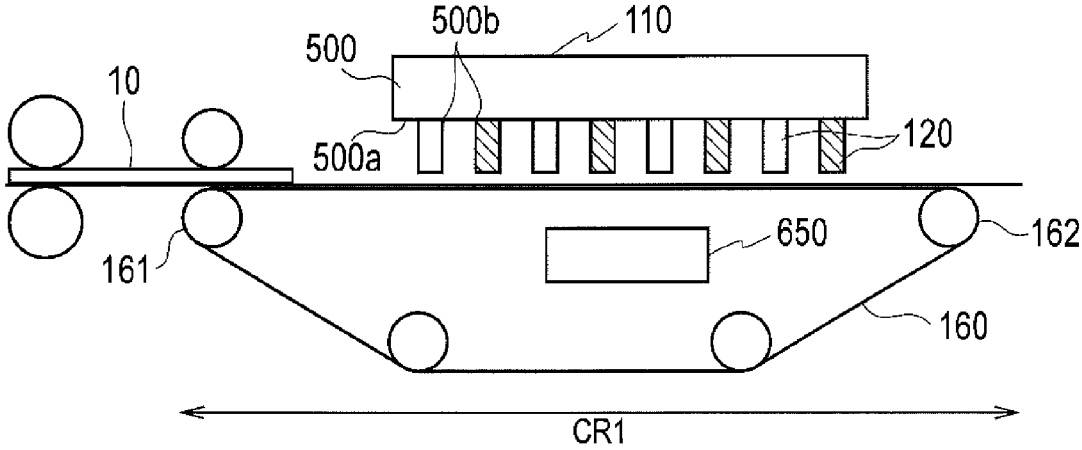
FIG. 2 is an explanation diagram showing, from a lateral side, an image formation path of FIG. 1 along which an image is formed.
Figure 3A:
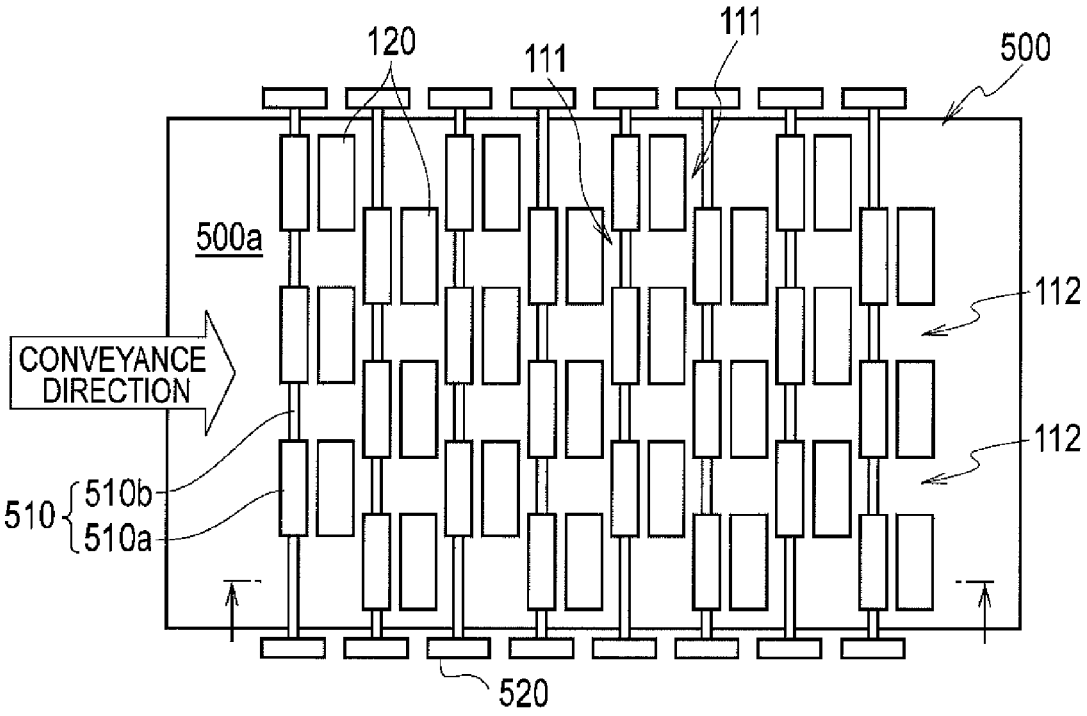
FIG. 3A is an explanation diagram showing a head holder, which is placed above a conveyance path in the inkjet recording apparatus of FIG. 1, as viewed from below.
Figure 3B:
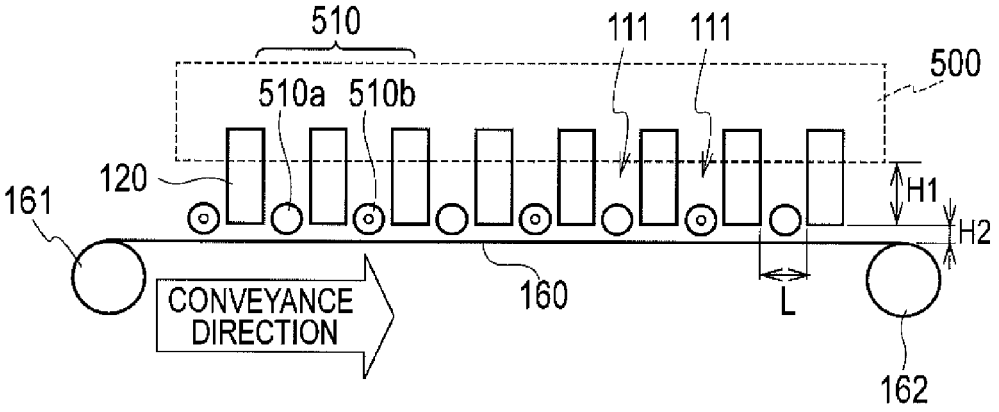
FIG. 3B is an explanation diagram showing, in a magnified manner, a side cross section of the head holder which is placed above the conveyance path in the inkjet recording apparatus of FIG. 1.
Figure 4:
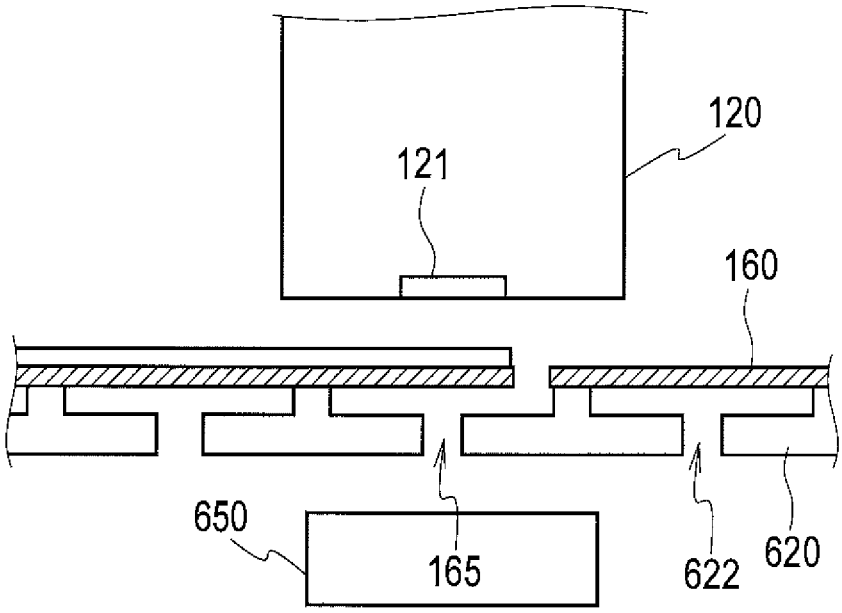
FIG. 4 is a magnified side view of a part of the image formation path of FIG. 1.

An embodiment of the present invention is described with reference to the drawings. FIG. 1 is a schematic cross-sectional diagram showing an internal configuration of an inkjet recording apparatus according to a first embodiment of the present invention. FIG. 2 is an explanation diagram showing, from a lateral side, an image formation path along which an image is formed. FIG. 3A is an explanation diagram showing a head holder, which is placed above a conveyance path in the inkjet recording apparatus of FIG. 1, as viewed from below. FIG. 3B is an explanation diagram showing, in a magnified manner, a side cross section of the head holder. FIG. 4 is a magnified side view of a part of the image formation path of FIG. 1.

Note that the inkjet recording apparatus of the embodiment is an inkjet-type line color printer configured to perform printing on a per-line basis by ejecting either black or colored ink from nozzles of ink heads included in a head unit serving as an image formation unit.

As shown in FIG. 1, an inkjet recording apparatus 100 is a printing machine configured to eject ink onto and thereby form an image on a print sheet 10 being conveyed along a conveyance path. In this embodiment, the inkjet recording apparatus 100 is an inkjet-type line color printer including: a paper feed unit configured to feed a print sheet 10; a sheet conveyance unit (including a platen belt 160) configured to convey the print sheet 10; a sheet discharge port 150 as a sheet discharge unit configured to discharge a printed print sheet 10; and the like.

The inkjet recording apparatus 100 includes multiple ink heads 120 as a printing mechanism, which extends in a direction orthogonal to a sheet conveyance direction and has multiple nozzles formed therein, and forms an image on a per-line basis by ejecting either black or colored ink from a nozzle 121 of each ink head 120.

The inkjet recording apparatus 100 also includes: a processing unit 330 formed of, for example, a controller board on which a CPU, a memory, and the like are placed; a manipulation panel which displays a menu and accepts manipulation by the user, for example; and other function units (not illustrated).

Print sheets are fed one by one from the paper feed unit such as a side paper feed tray or a front paper feed tray, conveyed along a paper-feed-system conveyance path inside a chassis by drive mechanisms such as a roller, and guided to register rollers 240. Here, the register rollers 240 are a pair of rollers provided to align leading edges of and correct skew orientation of a print sheet. A fed print sheet is suspended by the register rollers 240, and conveyed toward a head unit 110 at predetermined timing.

As shown in FIG. 2, an image formation path CR1 is provided downstream of the register rollers 240 in the conveyance direction.

The inkjet recording apparatus 100 of the embodiment includes the image formation path CR1 as its conveyance path. The print sheet 10 is conveyed on the platen belt 160 along the image formation path CR1 at a speed determined depending on print conditions. Above the image formation path CR1, the head unit 110 is placed opposed to the platen belt 160. The nozzles of the ink heads 120 included in the head unit 110 eject ink of multiple colors onto the print sheet 10 on the platen belt 160 on a per-line basis, so that multiple images are formed thereon to overlap one another.

More specifically, the image formation path CR1 includes: the platen belt 160 which is an endless conveyer belt; and a drive roller 161 and a driven roller 162 which are drive mechanisms of the platen belt 160; and the like. A head holder 500 holding the ink heads 120 is provided above the image formation path CR1.

The head holder 500 is a box having a head holder surface 500*a* as its bottom surface. The head holder 500 is configured to hold and fix the ink heads 120 therein as well as house, as a unit, other function parts for ejecting ink from the ink heads 120. Moreover, the head holder surface 500*a* being the bottom surface of the head holder 500 is placed opposed to and parallel to the conveyance path. Multiple attachment openings 500*b* having the same shapes as horizontal cross sections of the respective multiple ink heads 120 constituting the head unit 110 are arranged in the head holder surface 500*a*. The ink heads 120 are inserted into the respective attachment openings 500*b* while their discharge ports protrude from the head holder surface 500*a*.

The image formation path CR1 also includes a mechanism for changing a distance (head gap) between an ejection surface of each ink head 120 and the platen belt 160 in order to prevent the print sheet 10 from hitting against the ink heads 120. This mechanism is configured to change the distance between the ejection surfaces of the ink heads 120 and the platen belt 160 by moving the platen belt 160 vertically with respect to the ink heads 120.

As shown in FIG. 3A, the ink heads 120 are arranged in rows in a direction (main-scanning direction) orthogonal to the conveyance direction (sub-scanning direction). The ink heads 120 in each of the rows are staggered so as not to overlap the ink heads 120 of the adjacent rows in the conveyance direction. The rows of the ink heads 120 are arranged at predetermined intervals in the conveyance direction, and a main-scanning flow path 111 is formed between every two adjacent rows. The ink heads 120 adjacent in each row are arranged at predetermined intervals, and a sub-scanning flow path 112 is formed between every two adjacent ink heads 120, 120. The main-scanning flow paths 111 and the sub-scanning flow paths 112 communicate with one another to form a mist discharge path in the form of mesh.

Each main-scanning flow path 111 is provided with a stepped guide roller 510. The stepped guide roller 510 is formed by coupling guide rollers of different diameters together into one roller, and is formed by carving a metal rod, for example. More specifically, the stepped guide roller 510 has such a configuration that upstream guide rollers 510*a* having a large diameter and downstream guide rollers 510*b* having a diameter smaller than those of the upstream guide rollers 510*a* are alternately arranged and coupled together on a single rotational axis.

Each upstream guide roller 510*a* is provided upstream of the corresponding ink head 120 in the conveyance direction, and is rotated by being biased downward and pressed against an upper surface of the conveyance path. On the other hand, each downstream guide roller 510*b* is provided downstream of the corresponding ink head 120 in the conveyance direction, and is rotatably supported at a position away from the upper surface of the conveyance path by a predetermined distance.

The upstream guide rollers 510*a* and the downstream guide rollers 510*b* are also staggered to correspond to the staggered arrangement of the ink heads 120. Moreover, because the stepped guide rollers 510 are arranged in the main-scanning flow paths 111, the upstream guide rollers 510*a* and the downstream guide rollers 510*b* are also arranged in the main-scanning flow paths 111 alternately.

Meanwhile, the platen belt 160 is an endless belt member configured to convey a recording medium. As shown in FIG. 2, the platen belt 160 circles by means of the drive roller 161 and slides in an area opposed to the ink heads 120 to convey the print sheet 10. More specifically, the platen belt 160 is wound around the pair of the drive roller 161 and the driven roller 162 which are arranged orthogonal to the conveyance direction in which the print sheet 10 is conveyed, and circles in the conveyance direction by means of the drive force of the drive roller 161.

Moreover, as shown in FIG. 4, the platen belt 160 has many belt holes 165 for adsorbing a print sheet 10, and a platen plate 620 is placed below the platen belt 160. The platen plate 620 is a plate-shaped member configured to slidably support the platen belt 160 at a position opposed to the ink heads 120 and having many suction holes 622 made by penetrating the platen plate 620 at locations where the belt holes 165 pass. A suction fan 650 serving as a suction unit is provided below the platen plate 620.

The suction fan 650 is the suction unit configured to generate a negative pressure for adsorbing a print sheet 10 located on the upper surface of the platen belt through the suction holes and the belt holes 165. The negative pressure generated by the suction fan 650 adsorbs the print sheet 10 on the platen belt 160. Further, the negative pressure generated by the suction fan 650 generates an airstream which flows downward after passing through the belt holes 165 of the platen belt 160 and the suction holes 622 of the platen plate 620.

The print sheet 10 is conveyed along the image formation path CR1 having the above configuration, by the annular platen belt 160 provided opposed to the ink heads 120, at a speed according to the print conditions. While the sheet is conveyed on this path, an image is formed thereon on a per-line basis by ink ejected by each of the ink heads 120.

The ink heads 120 are configured to eject ink of four colors: K (black); C (cyan); M (magenta); and Y (yellow). On a bottom surface of each ink head 120, multiple nozzles 121 for ejecting ink are arranged in the main-scanning direction.

Ink droplets are ejected from the nozzles 121 by a predetermined volume (drop volume) for each pixel, whereby an image subjected to gradation processing is formed. Specifically, ink is ejected to each pixel in units of drops from the nozzles 121 in accordance with a drive signal transmitted from the processing unit 330. The density of each color is changed by the number of droplets of ink ejected (the number of drops), and the volume of each droplet is adjusted as a drop size. In this event, a conveyance airstream flowing from upstream to downstream in the conveyance direction is generated when the print sheet 10 is conveyed to a position right below the ink head. Moreover, a self-produced airstream flowing from the ink head 120 toward the print sheet 10 is generated constantly because the ink droplets 20 are continuously ejected from the nozzles 121.

The processing unit 330 is a computing module formed of: hardware including a processor such as a CPU or DSP (Digital Signal Processor), a memory, and other electronic circuits; software including programs having the function of such hardware; or a combination of these. The processing unit 330 is configured to virtually build various functional modules by loading and executing programs as appropriate, and to perform processing related to image data, control over operations of the respective parts, and various kinds of processing in response to the user's manipulation by use of the functional modules thus built. In particular, in the embodiment, the processing unit 330 has a function of correcting ink ejection timing in order to correct the landing deviation caused on the image formation path CR1 by the conveyance airstream and the self-produced airstream.

(Internal Configuration of Processing Unit 330)

The ink ejection timing correcting function described above is implemented by causing the processing unit 330 of the inkjet recording apparatus 100 to control operations of the head unit 110 and the other drive units.

Figure 5:
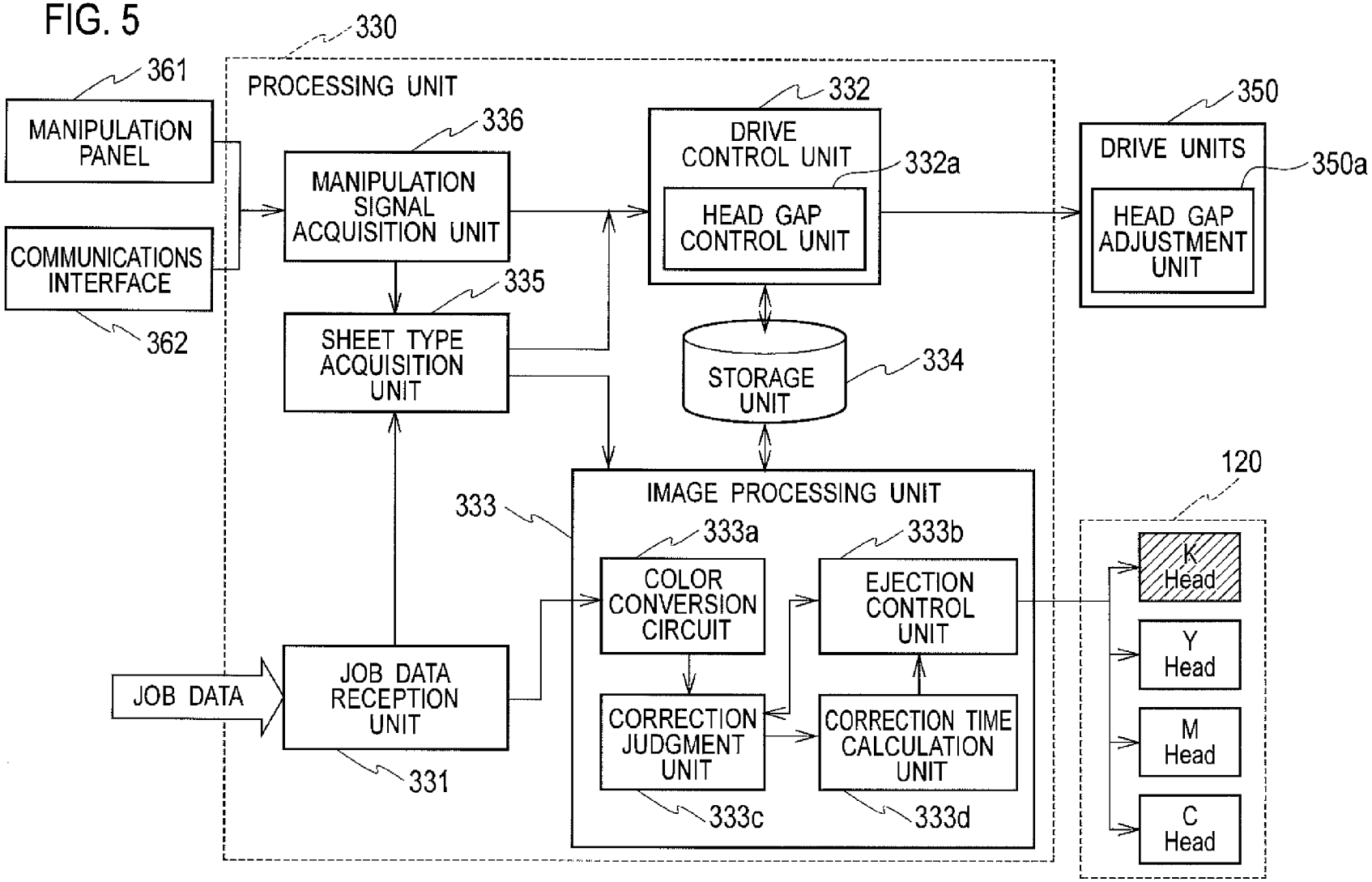
FIG. 5 is a block diagram showing functional modules of a processing unit of FIG. 1 which relate to an ejection timing correction function.
Figure 7A:
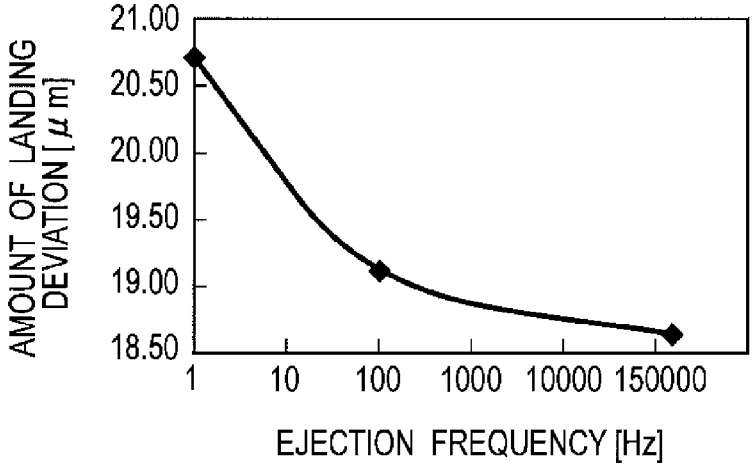
FIG. 7A is a graph showing the relationship between the ink ejection frequency and the amount of landing deviation in the profile data of FIG. 6, and is a graph showing the case where the head gap is 1.6 mm.
Figure 7B:
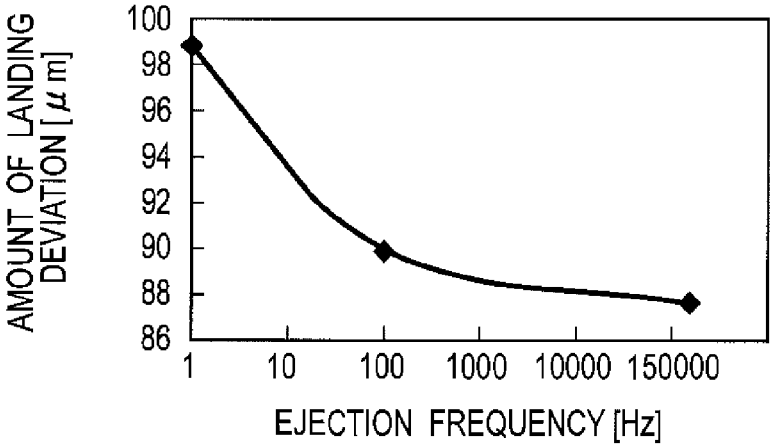
FIG. 7B is a graph showing the relationship between the ink ejection frequency and the amount of landing deviation in the profile data of FIG. 6, and is a graph showing the case where the head gap is 3.0 mm.
Figure 8:
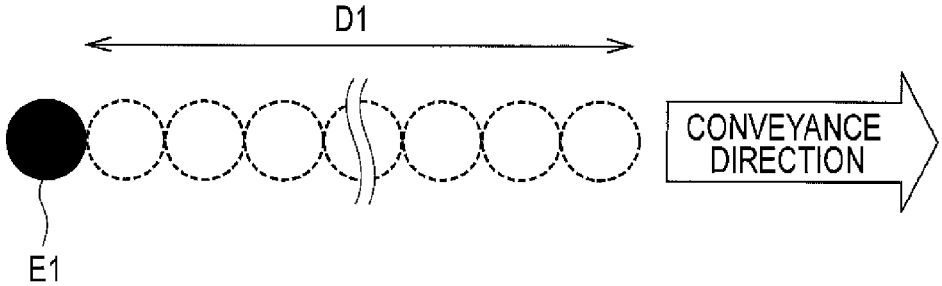
FIG. 8 is a top view for explaining a unit line to be selected by the processing unit of FIG. 1.

FIG. 5 is a block diagram showing ejection timing-related functional modules in the processing unit 330. FIG. 6 is an explanation diagram showing profile data on the amount of landing deviation with respect to the ink ejection frequency stored in a storage unit 334. FIGS. 7A and 7B are graphs showing the relationship between the ink ejection frequency and the amount of landing deviation in the profile data of FIG. 6. FIG. 7A corresponds to the case where the head gap is 1.6 mm, whereas FIG. 7B corresponds to the case where the head gap is 3.0 mm. FIG. 8 is a top view for explaining a unit line selected by the processing unit 330.

Note that a "module" used in the description indicates a function unit for implementing a certain operation and is formed of: hardware such as a device or an instrument; software having the function of such hardware; or a combination of these.

As shown in FIG. 5, the processing unit 330 mainly includes: a job data reception unit 331; an image processing unit 333; a drive control unit 332; the storage unit 334; a manipulation signal acquisition unit 336; and a sheet type acquisition unit 335.

The job data reception unit 331 is a communication interface configured to receive job data being units of a series of print processing, and is a module configured to give the print data included in the received job data to the image processing unit 333. The communication mentioned here includes, for example, LANs including an intranet (intra-company network) and a home network via a 10BASE-T, 100BASE-TX, or the like, as well as short-distance communication such as infrared communication.

The manipulation signal acquisition unit 336 is a module configured to receive a manipulation signal inputted by the user through a manipulation panel 361, and is configured to analyze the received manipulation signal and make another module execute processing in response to the user's manipulation. In particular, in the embodiment, the manipulation signal acquisition unit 336 is configured to accept instruction manipulation on drop volume correction processing and print setting information such as the type of the print sheet 10, from the manipulation panel 361, a printer driver connected thereto through external communication, or the like.

The sheet type acquisition unit 335 is a module configured to acquire sheet type data on paper feed, such as the size, type, or thickness of the print sheet 10, detected by the job data reception unit 331 and the manipulation signal acquisition unit 336. At the time of print processing, the sheet type acquisition unit 335 transmits the acquired sheet type data to the drive control unit 332 and the image processing unit 333.

The storage unit 334 is a memory device or the like configured to store and hold various kinds of data and programs on image processing. The data stored and held in the storage unit 334 includes: information on a conveyance speed at which to convey a print sheet; and head gap setting information which is information defined based on information on the thickness of the print sheet 10 and related to a distance between the platen belt 160 and the ejection surface of each ink head 120.

As shown in FIG. 6, the data stored and held in the storage unit 334 also includes profile data in which a distance between a theoretical ejection landing position and an actual ejection landing position is defined as the amount of landing deviation in association with each ejection frequency. In the profile data, the amount of landing deviation in association with each ejection frequency is stated for each head gap distance, i.e., for each distance between the platen belt 160 and the ejection surface of each ink head 120.

By using FIGS. 7A and 7B, a description is given of the relationship between the ejection frequency and whether a self-produced airstream W2 is generated at the head gap, and the amount of landing deviation caused by the conveyance airstream W1 and the self-produced airstream W2. In FIGS. 7A and 7B, the horizontal axis indicates the ejection frequency (unit: [Hz]) which denotes the average number of times of ejection of ink droplets per unit time, and the vertical axis indicates the amount of landing deviation (unit: [μm]).

The ejection frequency is defined as the number of times each nozzle 121 ejects ink droplets 20 per unit time. The ejection time interval is long at an ejection frequency of 1 Hz, and becomes shorter as the ejection frequency comes closer to 150 KHz. As shown in FIGS. 7A and 7B, ink ejection at an ejection frequency of 1 Hz generates no self-produced airstream W2 from the nozzle 121, and therefore exhibits a large amount of landing deviation attributable to the influence of only the conveyance airstream W1. On the other hand, as the ejection frequency gets closer to 150 KHz, the influence of the self-produced airstream W2 becomes larger, and hence the amount of landing deviation becomes smaller.

Note that, in the embodiment, the ejection frequency of 1 Hz is defined as a frequency calculated when a total volume of ink ejected per 30 dots is less than 1 drop. The ejection frequency of 150 KHz indicates a frequency calculated when a total volume of ink ejected per 30 dots is equal to the maximum ink volume. Here, the maximum ink volume denotes the volume of ink ejected in the case where seven drops are ejected to each of 30 dots using a multidrop technique.

Hereinbelow, the maximum number of times each nozzle 121 is capable of ejecting ink droplets 20 per unit time is defined as a maximum ejection frequency MD (unit: [Hz]). In the embodiment, the maximum ejection frequency MD is equal to the ejection frequency of 150 KHz.

The profile data may be set individually for each inkjet recording apparatus 100 while an individual difference among inkjet recording apparatuses 100 is taken into consideration. Information on the individual difference includes, for example, information on a change in each of the airstreams depending on information on: a distance (head gap) between the ejection surface of each ink head 120 and the platen belt 160; and meandering of the platen belt 160 for conveying the print sheet 10. Further, although the profile data is acquired at the time of factory shipment in the embodiment, the acquisition timing is not limited to the timing of factory shipment. Instead, the profile data may be acquired at the time of print start, environmental change, temporal change, or maintenance.

The drive control unit 332 is a module configured to control the operations of the respective functions in the inkjet recording apparatus 100 such as a drive unit 350 configured to drive the parts on the conveyance path. In the embodiment, the drive control unit 332 includes a head gap control unit 332*a*.

The head gap control unit 332*a* is a module configured to control a head gap adjustment unit 350*a* by referring to head gap setting information stored in the storage unit 334 on the basis of information on the thickness of the print sheet 10 acquired from a print job, in such a way that a clearance (head gap) between each ink head 120 and the platen belt 160 depending on the thickness of the print sheet 10 becomes equal to a predetermined distance.

The head gap adjustment unit 350*a* is a mechanism configured to change the distance between each ink head 120 and the platen belt 160 in order to prevent the print sheet 10 from hitting against the ink head 120. The head gap adjustment unit 350*a* changes the distance between the ink head 120 and the platen belt 160 by, for example, causing the drive mechanism controlled by electrical signals to move the platen belt 160 vertically with respect to the ink head 120. Alternatively, the ink head 120 may be moved with respect to the platen belt 160.

The image processing unit 333 is a processor configured to perform digital signal processing specialized for image processing, and is a module configured to perform conversion on image data and the like necessary for printing and execute the printing. The image processing unit 333 includes an ejection control unit 333*b* and a color conversion circuit 333*a*.

The color conversion circuit 333*a* is a module configured to convert a RGB print image being acquired image data into a CMYK print image. In the embodiment, the color conversion circuit 333*a* subjects the image data to halftone processing to convert it into image data related to the volume of drops of the ink heads 120.

The ejection control unit 333*b* is a module configured to control ejection from the nozzles 121 for ejecting ink onto the print sheet 10. The ejection control unit 333*b* calculates the volume of ink to be ejected to each dot on the basis of the image data subjected to the image processing, and ejects ink drops, the number of which is determined based on the gradations of the image data, for each dot at predetermined timing. In the embodiment, the ejection control unit 333*b* is set in advance to eject ink at the corrected ejection timing obtained by correcting the regular timing, in order to eliminate the amount of landing deviation caused by the conveyance airstream W1. The amount of correction to the ejection timing (default correction amount) may be changed by a re-correction instruction made by a correction judgment unit 333*c*.

In addition, the image processing unit 333 includes the correction judgment unit 333*c* and a correction time calculation unit 333*d* as functions to determine how much to change the default correction amount in accordance with the amount by which the amount of landing deviation caused by the conveyance airstream W1 is changed by the generation of the self-produced airstream W2, the default correction amount being used when the ejection control unit 333*b* corrects the ejection timing.

The correction judgment unit 333*c* is a module configured to judge whether or not the self-produced airstream W2 will be generated constantly when ink is ejected from a certain nozzle 121. In the embodiment, the correction judgment unit 333*c* judges whether or not the self-produced airstream W2 will be generated constantly by referring to a history of ejection from the nozzle 121 in a certain area including multiple pixels and comparing it with a predetermined threshold.

More specifically, as shown in FIG. 8, the correction judgment unit 333*c* selects, as a unit line D1, a certain area covering 30 dots which are continuously arranged downstream in the conveyance direction of a certain nozzle E1 for ejecting ink. Then, the correction judgment unit 333*c* multiplies the volume of each ink droplet by the number of drops for each dot in the unit line D1 to obtain a total volume of ink ejected in the unit line D1. Meanwhile, a volume of ink per unit line D1, with which a self-produced airstream W2 would be generated constantly, is set as the threshold.

Then, if the total volume of ejected ink is equal to or smaller than the predetermined threshold, the correction judgment unit 333*c* judges that no self-produced airstream W2 will be generated constantly, and sends the ejection control unit 333*b* this judgment result as a re-correction instruction that no change needs to be made on the default correction amount. On the other hand, if the total volume of ejected ink is equal to or larger than the predetermined threshold, the correction judgment unit 333*c* judges that a self-produced airstream W2 will be generated constantly, and sends the judgment result to the correction time calculation unit 333*d*.

Note that, in the embodiment, the correction judgment unit 333*c* compares the total volume of ink ejected per unit line D1 with the threshold; however, the correction judgment unit 333*c* may further judge whether or not one or more ink droplets are ejected to every dot in the unit line D1. In this case, the correction judgment unit 333*c* judges that the self-produced airstream W2 will be generated constantly if one or more ink droplets are ejected continuously.

In short, the threshold which is used for the correction judgment unit 333*c* to judge whether the self-produced airstream W2 will be generated constantly can be set in the form of parameters, such as the volume of ejected ink and the number of ink droplets for each dot, which reflect the situation where the self-produced airstream W2 is generated constantly. These are parameters for estimating the self-produced airstream rate as the generation rate of the self-produced airstream.

The correction time calculation unit 333*d* is a module configured to calculate the amount of correction time, by which the ejection timing is to be adjusted, by calculating the amount of landing deviation due to the conveyance airstream W1 and the self-produced airstream W2 on the basis of the total volume of ejected ink, in response to the judgment result from the correction judgment unit 333*c* that there is a self-produced airstream W2.

Specifically, while taking into consideration the fact that the amount of landing deviation due to the conveyance airstream W1 varies depending on the influence of the self-produced airstream W2, the correction time calculation unit 333*d* calculates, as a correction time Δt (unit: [μs]), the amount of change to be made to the default correction amount, which the ejection control unit 333*b* uses for the ejection timing correction, in accordance with the amount of variation in the amount of landing deviation, if the correction judgment unit 333*c* judges that there is a self-produced airstream W2. More specifically, the correction time calculation unit 333*d* calculates the difference between the amount of landing deviation caused when only the conveyance airstream W1 is generated and the amount of landing deviation caused when both the conveyance airstream W1 and the self-produced airstream W2 are generated and, from this difference, calculates the correction time Δt which is the amount of change to be made to the default correction amount.

Here, the amount of landing deviation caused when only the conveyance airstream W1 is generated is the amount of landing deviation caused in a condition where there is no influence of the self-produced airstream W2. Hence, this amount is equal to the amount of landing deviation f(1) at an ejection frequency of 1 Hz whose ejection time interval is long as shown in FIGS. 7A and 7B.

On the other hand, when both the conveyance airstream W1 and the self-produced airstream W2 are generated, the landing position of ink gets closer to a point without landing deviation since the ink is drifted back to the upstream side in the conveyance direction under the influence of the self-produced airstream W2. Hence, as shown in FIGS. 7A and 7B, the amount of landing deviation caused in this case is equal to the amount of landing deviation (f(x)) at an ejection frequency of any of 1 Hz to 150 KHz.

Thus, a correction time Δt1 obtained by the following equation (EQ1) is set as the correction time 66 t:

$$\Delta t1=(f(1)-f(x))/v \quad \text{(EQ1)}$$

where f(1) indicates the amount of landing deviation (unit: [μm]) at an ejection frequency of 1 Hz, f(x) indicates the amount of landing deviation (unit: [μm]) at an estimated ejection frequency x (unit: [Hz]), and v indicates a conveyance speed (unit: [μm/μs]) of the platen belt 160.

The correction time calculation unit 333*d* needs to obtain the estimated ejection frequency x for the purpose of calculating the amount of landing deviation f(x) including the influence of the self-produced airstream W2. To this end, in the embodiment, the estimated ejection frequency x is obtained by: calculating a correction coefficient α, which indicates how much the self-produced airstream W2 affects the landing position of ink droplets 20, from the ratio of the number of dots and the number of times of ink ejection in the unit line D1 to the maximum number of dots and the maximum number of times of ink ejection in the unit line D1; and multiplying the correction coefficient α by the ejection frequency of 150 KHz which is the maximum ejection frequency MD.

Specifically, the correction coefficient α is obtained by the following mathematical formula:

(correction coefficient α)=(correction coefficient α in unit line *D*1)=(number of ejected dots/total number of dots in unit line *D*1)×(average number of drops for each dot/maximum number of drops ejected to each dot)

where (average number of drops for each dot)=(total number of ejected drops/number of ejected dots).

The estimated ejection frequency x is obtained by the following mathematical formula:

(estimated ejection frequency *x*)=(correction coefficient α)×(maximum ejection frequency MD)

Then, the correction time Δt is calculated using the estimated ejection frequency x obtained from the correction coefficient α. Now, a description is given of how to calculate the correction time Δt. Here, the case where the conveyance speed of the platen belt 160 is 0.632 μm/μs and the head gap is 3.0 mm is described.

In a case where the history of ejection in the unit line D1 shows that a maximum of 7 drops are ejected to each of 30 dots, for example, the correction coefficient α is obtained as follows:

(correction coefficient α)=(30 dots/30 dots)×(7 drops/7 drops)=1

Meanwhile, in the case where the history of ejection in the unit line D1 shows a maximum of 7 drops are ejected to each of 15 dots, for example, the correction coefficient α is obtained as follows:

(correction coefficient α)=(15 dots/30 dots)×(7 drops/7 drops)=0.5

When the correction coefficient α is 1, the estimated ejection frequency x is equal to 150 KHz because the maximum ejection frequency MD is 150 KHz in the embodiment. When the estimated ejection frequency x is the ejection frequency of 150 KHz, the amount of landing deviation f(150000) is 87.69 μm as shown in FIG. 6. Accordingly, the correction time Δt in this case is as follows:

$$\Delta t=(98.91-87.69)/0.632=17.75\ [\mu s].$$

When the estimated ejection frequency x is the ejection frequency of 100 Hz, the amount of landing deviation f(100) is 89.96 μm as shown in FIG. 6. Accordingly, the correction time Δt in this case is as follows:

$$\Delta t=(98.91-89.96)/0.632=14.16\ [\mu s].$$

As described above, correction data on the correction time Δt calculated from the correction coefficient α and the estimated ejection frequency x is transmitted to the ejection control unit 333*b*. Based on the correction data, the ejection control unit 333*b* corrects the drive signal in such a way that the ejection timing is moved forward by the correction time Δt so that ink may land at the same position as the landing position obtained by correcting the amount of landing deviation which would be caused by the conveyance airstream W1 in the case of a single-shot ejection of the ink. Then, the ejection control unit 333*b* inputs the corrected signal into the ink heads 120. For example, when the correction coefficient is 1, the ejection control unit 333*b* performs control such that the ejection timing becomes earlier by 17.75 μs than the ejection timing corresponding to the conveyance airstream W1.

To put it simply, the ejection control unit 333*b* changes (adjusts) the default amount of correction to the ejection timing, which is determined depending on the amount of landing deviation due to the conveyance airstream W1, by use of the correction time Δt in accordance with the self-produced airstream rate corresponding to the amount of change in the amount of landing deviation caused by the self-produced airstream W2.

(Ejection Timing Correction Operation)

Figure 9:
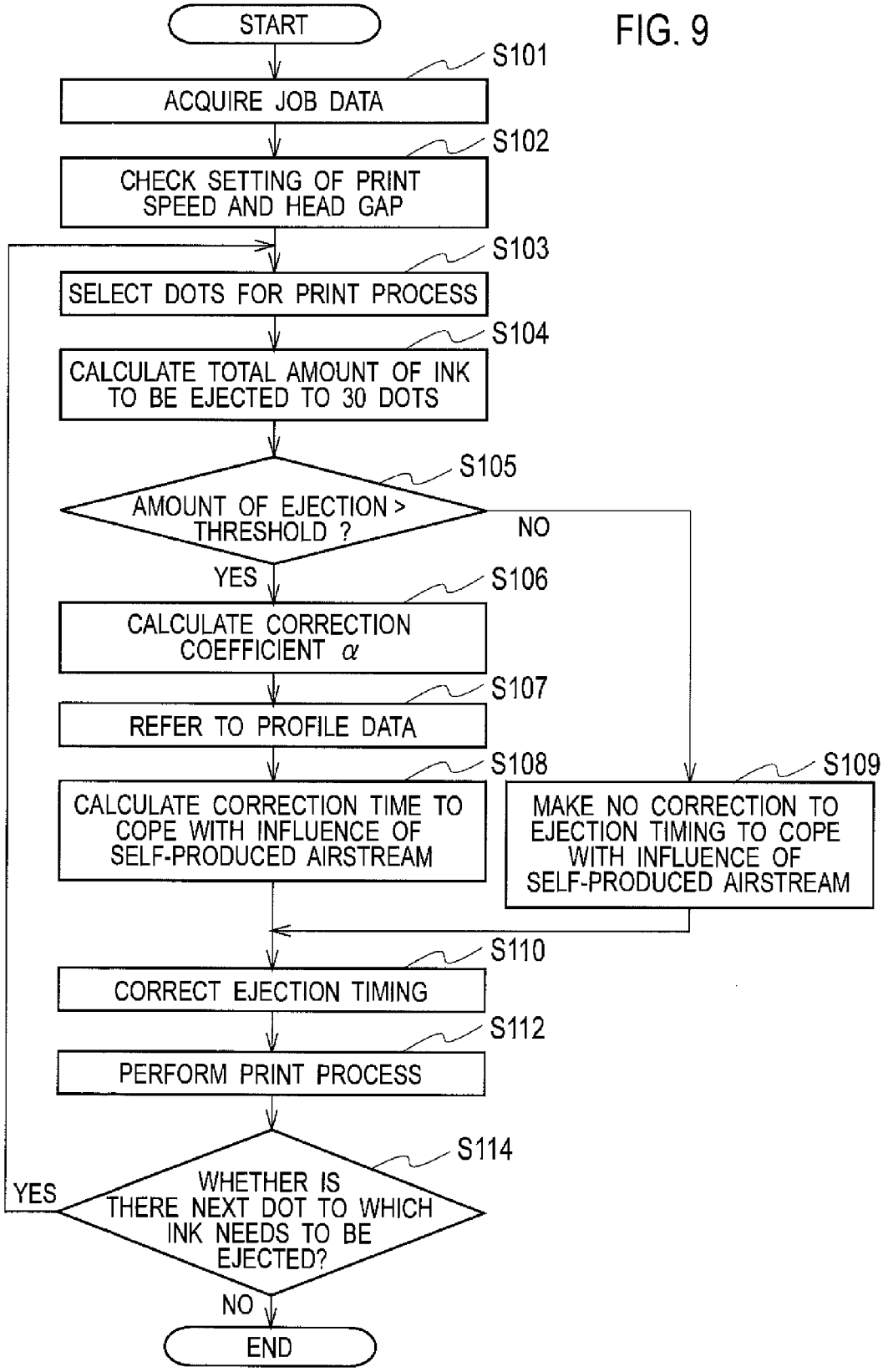
FIG. 9 is a flowchart briefly showing an ejection timing correction operation in the inkjet recording apparatus of FIG. 1.

Next, a description is given of an ejection timing correction operation in the inkjet recording apparatus 100 having the above configuration. FIG. 9 is a flowchart showing the ejection timing correction operation in the inkjet recording apparatus 100.

As shown in FIG. 9, first of all, the job data reception unit 331 receives job data (Step S101), and transmits the job data to the image processing unit 333 and the sheet type acquisition unit 335. The sheet type acquisition unit 335 acquires sheet thickness information from the type of a print sheet 10 included in the job data, and inputs the thickness information into the drive control unit 332 and the image processing unit 333. The head gap control unit 332*a* of the drive control unit 332 having acquired the thickness information determines the distance between the platen belt 160 and the ejection surface of each ink head 120 with reference to the head gap setting information in the storage unit 334, and drives and controls the head gap adjustment unit 350*a*.

Meanwhile, the image processing unit 333 acquires information on the distance (head gap) between the platen belt 160 and the ejection surface of each ink head 120 stored in the storage unit 334, on the basis of the sheet type information. From the storage unit 334, the image processing unit 333 also acquires setting information on the conveyance speed of the platen belt 160 (Step S102).

Upon receiving the job data, the image processing unit 333 first causes the color conversion circuit 333*a* to subject image data in the job data to halftone processing to create image data on the number of drops to be ejected from each nozzle 121 for each dot and the volume of each drop, and inputs the image data into the correction judgment unit 333*c* and the ejection control unit 333*b*.

The ejection control unit 333*b* ejects ink onto the print sheet 10 sequentially from a leading end portion of the sheet in the conveyance direction, on the basis of the image data calculated by the color conversion circuit 333*a*. In this event, the ejection control unit 333*b* determines whether or not to perform adjustment (correction) to cancel the ejection timing control for eliminating the landing deviation due to the influence of the conveyance airstream W1 by the amount equivalent to the amount of change in the landing position due to the influence of the self-produced airstream W2, on the basis of the result of judgment on whether or not a self-produced airstream W2 is generated from each nozzle constantly, the judgment result being transmitted from the correction judgment unit 333*c*.

More specifically, the correction judgment unit 333*c* selects, as a unit line (predetermined area) D1, 30 dots which are arranged downstream of a certain nozzle E1 for ejecting ink in the conveyance direction. Then, referring to the history of ejection in the unit line D1, the correction judgment unit 333*c* calculates a total volume of ejected ink from the volume of each ink droplet, the number of drops ejected to each dot, and the number of dots (30 dots) (Step S104). The correction judgment unit 333*c* also judges whether or not the total volume of ejected ink, thus obtained, is equal to or larger than the predetermined threshold (Step S105).

If the total volume of ejected ink is not equal to or larger than the predetermine threshold (if NO in step S105), the correction judgment unit 333*c* judges that no self-produced airstream W2 will be generated constantly, and sends the ejection control unit 333*b* this judgment result as a re-correction instruction that no change needs to be made to the default correction amount (Step S109). Here, when ink is ejected for the first time, for example, a total volume of ejection is zero because no ejection history exists. Accordingly, it is judged that no self-produced airstream W2 will be generated constantly and, in response to this judgment result, the ejection control unit 333*b* ejects ink from each nozzle 121 at the previously defined ejection timing corresponding to the amount of landing deviation due to the conveyance airstream W1 (the ejection timing obtained by correcting the regular ejection timing by means of the default correction amount) (Step S110). Note that ejection history information made at this time is transmitted to the correction judgment unit 333*c*.

On the other hand, if the total volume of ejected ink is equal to or larger than the predetermined threshold (if YES in Step S105), the correction judgment unit 333*c* judges that the self-produced airstream W2 will be generated constantly, and transmits this judgment result to the correction time calculation unit 333*d*.

Upon acquisition, from the correction judgment unit 333*c*, of the judgment result that the self-produced airstream W2 will exist, the correction time calculation unit 333*d* first calculates the correction coefficient $\alpha$ from the history of ejection in the unit line D1, i.e., 30 dots (Step S106). Then, the correction time calculation unit 333*d* obtains an estimated ejection frequency x by multiplying the correction coefficient a by the ejection frequency of 150 KHz which is the maximum ejection frequency MD.

After that, while referring to the profile data in FIG. 6, on the basis of the estimated ejection frequency x (Step S107), the correction time calculation unit 333*d* calculates the amount of landing deviation f(x) including the influence of the self-produced airstream W2, which will occur in the next ink ejection.

Subsequently, based on the calculated amount of landing deviation f(x), the correction time calculation unit 333*d* calculates the correction time $\Delta t$ as correction data from the above equation (EQ1) (Step S108). The correction data on the correction time $\Delta t$ thus calculated is inputted into the ejection control unit 333*b*.

The ejection control unit 333*b* changes (adjusts) the default correction amount on the basis of the correction data, corrects the ejection timing using the default correction amount changed in such a way that the ejection timing becomes earlier than the timing before the change, and causes each nozzle 121 to eject ink at the corrected timing (Step S110). Thus, even when the self-produced airstream W2 is generated constantly, the ink lands at the same position as the position at which the ink would land if the ejection timing is corrected by using the default correction amount in the absence of the constant self-produced airstream W2.

The ink head 120 ejects ink from all of its nozzles 121 at the ejection timing corresponding to the amount of landing deviation due to the conveyance airstream W1 (Step S112). After that, the ink head 120 judges whether or not ink is to be ejected to the next dot with reference to the job data (Step S113). If ink is to be ejected to the next dot (if YES in Step S114), the processes from Step S103 to Step S112 are executed. On the other hand, if ink is not to be ejected to the next dot (if NO in Step S114), the process is terminated.

(Operation and Effect)

According to the embodiment described above, whether or not the self-produced airstream W2 will be generated constantly at the time of the next ejection of ink from a certain nozzle is judged by use of the threshold with reference to the history of ejection from the nozzle 121. In addition, according to the embodiment, if the self-produced airstream W2 will be generated constantly, the ejection frequency which causes the self-produced airstream W2 is obtained from the ink volume in the ejection history, and the correction is made such that the ejection timing is moved forward based on the amount of landing deviation associated with the ejection frequency thus obtained. This makes it possible to correct the ejection timing while taking into consideration not only the influence of the conveyance airstream W1 but also the influence of the self-produced airstream W2, and thereby to make ink land at an appropriate position in various ejection patterns including patterns accompanied by the self-produced airstream W2. In this way, according to the embodiment, even in the case where the self-produced airstream W2 is generated constantly, the ink landing position can be corrected to the right position as in the case where no self-produced airstream W2 is generated constantly, whereby a good image free from landing deviation can be provided.

Further, according to the embodiment, the correction judgment unit 333*c* judges whether or not the self-produced airstream W2 will be generated constantly by judging whether or not at least one ink droplet is ejected to each of 30 dots in the unit line D1 consecutively. Thereby, the self-produced airstream W2 caused by ejecting ink for the multiple pixels consecutively can be judged appropriately.

Furthermore, according to the embodiment, the ejection timing is corrected and controlled by calculating the correction time $\Delta t$ which varies depending on the head gap and the conveyance speed. This makes it possible to appropriately resolve a variation in the landing position, which varies depending on the type of the print sheet 10 and the conveyance speed, to improve the landing position accuracy, and thereby to provide a good image free from landing deviation.

(Second Embodiment)

Next, a second embodiment of the present invention is described. In the embodiment, in addition to the function described above, a description is given of a function of correcting the ejection timing to cope with an airstream caused by suction made by the suction fan 650.

Figure 10:
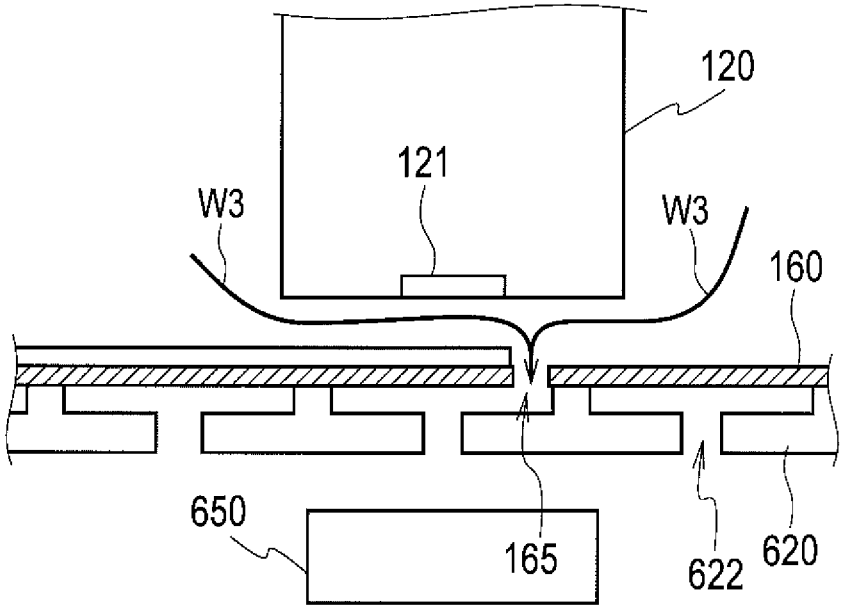
FIG. 10 is a side view showing a suction airstream generated right below an ink head of an inkjet recording apparatus according to a second embodiment.
Figure 11A:
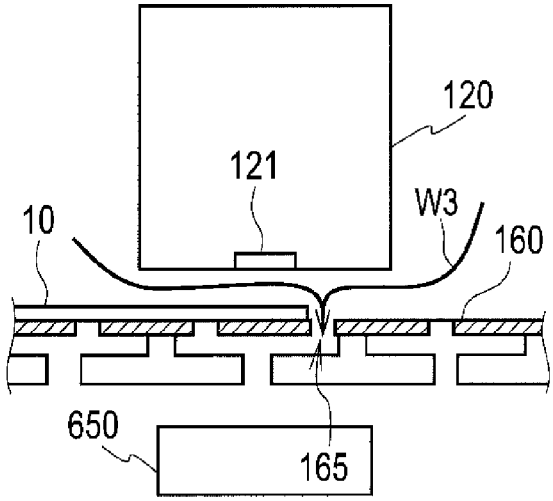
FIG. 11A is a side view showing the condition of the suction airstream generated depending on the conveyance position of a print sheet in FIG. 10, and showing the case where the leading end of the print sheet is located right below a nozzle.
Figure 11B:
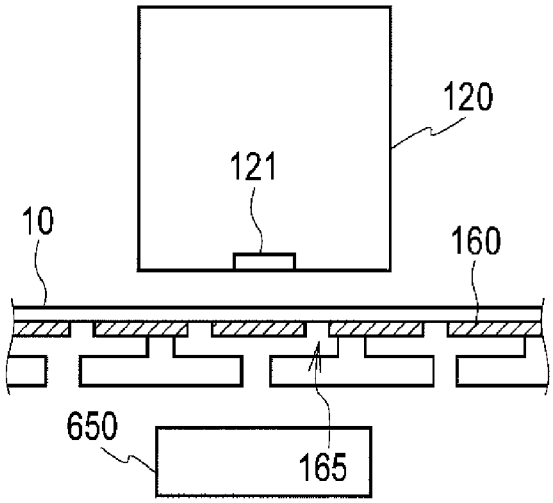
FIG. 11B is a side view showing the condition of the suction airstream generated depending on the conveyance position of the print sheet in FIG. 10, and showing the case where a central portion of the print sheet is located right below the nozzle.
Figure 11C:
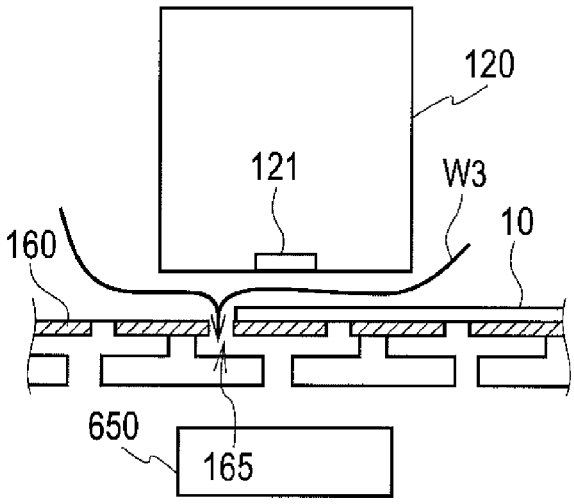
FIG. 11C is a side view showing the condition of the suction airstream generated depending on the conveyance position of the print sheet in FIG. 10, and showing the case where the trailing end of the print sheet is located right below the nozzle.
Figure 12:
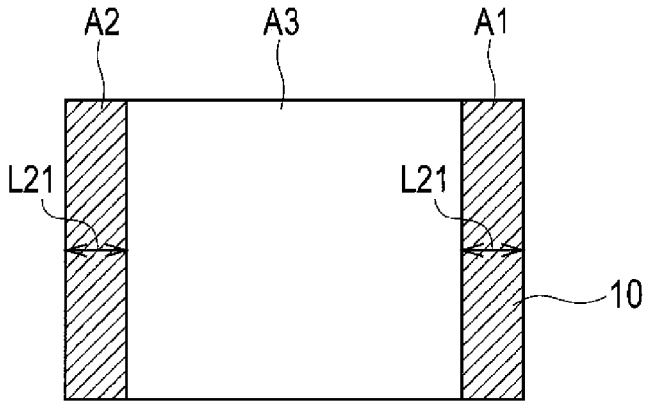
FIG. 12 is a top view showing a leading end area and a trailing end area of the print sheet which are judged by the processing unit of FIG. 1.
Figure 13A:
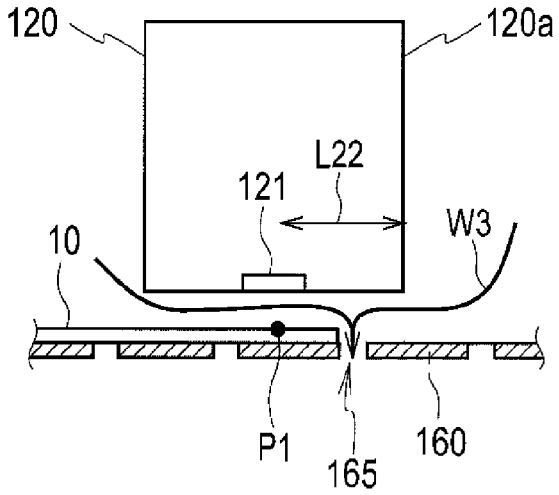
FIG. 13A is an explanation diagram showing the positional relationship between the ink head and the print sheet in the case where the suction airstream is generated right below the ink head.
Figure 13B:
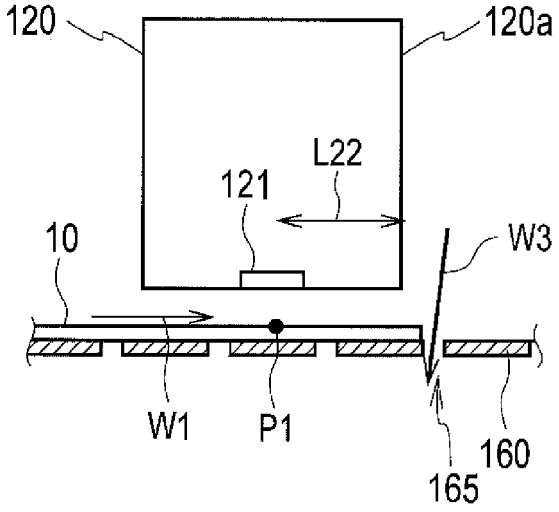
FIG. 13B is an explanation diagram showing the positional relationship between the ink head and the print sheet in the case where no suction airstream is generated right below the ink head.

FIG. 10 is an explanation diagram showing an airstream caused by suction, which is generated right below an ink head 120 of an inkjet recording apparatus according to the second embodiment. FIGS. 11A to 11C are explanation diagrams showing, from the lateral side, the condition of the airstream caused by suction, which is generated depending on the conveyance position of a print sheet 10. FIG. 11A shows the case where the leading end of the print sheet 10 is located right below a nozzle 121 of the ink head 120, FIG. 11B shows the case where a central portion of the print sheet 10 is located right below the nozzle 121, and FIG. 11C shows the case where the trailing end of the print sheet 10 is located right below the nozzle 121. FIG. 12 is a top view showing a leading end area A1 and a trailing end area A2 of the print sheet. FIGS. 13A and 13B are explanatory diagrams respectively showing the positional relationship between the ink head 120 and the print sheet 10 in the case where the airstream caused by suction is generated right below the ink head 120, and in the case where no such airstream is generated.

In the embodiment, the suction fan 650 serving as the suction unit is provided below the platen belt 160, as described above. As shown in FIG. 10, the negative pressure generated by the suction fan 650 generates an airstream which flows downward after passing through the belt holes 165 of the platen belt 160 and the suction holes 622 of the platen plate 620.

Here, the belt holes 165 of the platen belt 160 are closed depending on the position of the print sheet 10 being conveyed. Accordingly, in the case where the central portion of the print sheet 10 is located right below the nozzle 121 as shown in FIG. 11B, for example, no airstream to pass through the belt holes 165 is generated, and therefore ejected ink droplets 20 are affected only by the conveyance airstream W1.

On the other hand, in the case where the leading end or trailing end of the print sheet 10 is located right below the nozzle 121 as shown in FIGS. 11A and 11C, the negative pressure generated by the suction fan 650 generates an airstream passing through the belt holes 165, and ejected ink droplets 20 are affected by an airstream caused by the suction (hereinafter referred to as a suction airstream W3).

Hence, the embodiment includes the function of correcting the ejection timing to cope with the suction airstream W3 in accordance with the position of the print sheet 10 being conveyed right below the nozzle 121.

First of all, as shown in FIG. 12, the correction judgment unit 333*c* of the image processing unit 333 judges whether or not a pixel portion onto which ink is to be ejected is inside either the leading end area A1 or the trailing end area A2 of the print sheet 10. As described later, a width L21 of each of the leading end area A1 and the trailing end area A2 is determined as being equal to a distance L22 between a side surface 120*a* of the ink head and each nozzle 121.

For example, as shown in FIG. 13A, if the leading end of the print sheet 10 has not yet reached the side surface 120*a* located on the downstream side of the ink head 120 in the conveyance direction, the distance between the leading end of the print sheet 10 and a position P1 located right below the nozzle 121 is equal to or smaller than the predefined distance L22.

In this case, an airstream which flows downward through the belt holes 165 located below the ink head 120 is generated, which makes the air flow into the holes from the upstream and downstream in the conveyance direction. As a result, ink droplets 20 ejected from the nozzle 121 are affected by the suction airstream W3.

On the other hand, as shown in FIG. 13B, if the leading end of the print sheet 10 has already reached the side surface 120 located on the downstream side of the ink head 120 in the conveyance direction, the distance between the leading end of the print sheet 10 and the position P1 located right below the nozzle 121 is equal to or larger than the predetermined distance L22.

In this case, all of the belt holes 165 located below the ink head 120 are closed. In such a case, the air flows into the belt holes 165 located outside the ink head 120 from a space where no ink head 120 is located, and thus no suction function works on a space below the ink head 120. As a result, ink droplets 20 ejected from the nozzle 121 are not affected by the suction airstream W3.

The description has been given above of the fact that the influence which ink droplets 20 ejected from the nozzle 121 receive from the suction airstream W3 varies depending on the positional relationship between the leading end of the print sheet 10 and the side surface 120*a* located on the downstream side of the ink head 120 in the conveyance direction; however, a similar variation occurs depending on the positional relationship between the trailing end of the print sheet 10 and the side surface 120*a* located on the upstream side of the ink head 120 in the conveyance direction as well.

Specifically, the influence which ink droplets 20 ejected from the nozzle 121 receive from the suction airstream W3 varies depending on which position the nozzle 121 for ejecting ink is in among the leading end area A1 of the print sheet 10, the trailing end area A2 of the print sheet 10, and the central area A3 other than the leading end area A1 and the trailing end area A2 of the print sheet 10.

Accordingly, in the embodiment, the width of each of the leading end area A1 and the trailing end area A2 in which ink droplets 20 ejected from the nozzle 121 are affected by the suction airstream W3 is determined as the distance L22 between the side surface 120*a* of the ink head 120 and each nozzle 121.

In the embodiment, the distance between the side surface 120*a* of the ink head 120 and the nozzle 121 is 15 mm. Whether a pixel portion onto which ink is to be ejected is within an area of 15 mm from the leading end or the trailing end of the print sheet 10 may be acquired from a sensor provided on the conveyance path or instead maybe obtained from the conveyance condition of the print sheet 10, for example.

The correction judgment unit 333*c* judges that the leading end area A1 and the trailing end area A2 of the print sheet 10 are the areas to be affected by the airstream caused by the suction, and that the correction to the ejection timing due to the suction needs be made in these areas. On the other hand, the correction judgment unit 333*c* judges that the central area A3 other than the leading end area A1 and the trailing end area A2 of the print sheet 10 is the area not to be affected by the airstream caused by the suction, and that no correction to the ejection timing due to the suction needs to be made in this area, and performs control such as that in the first embodiment.

Figure 14:
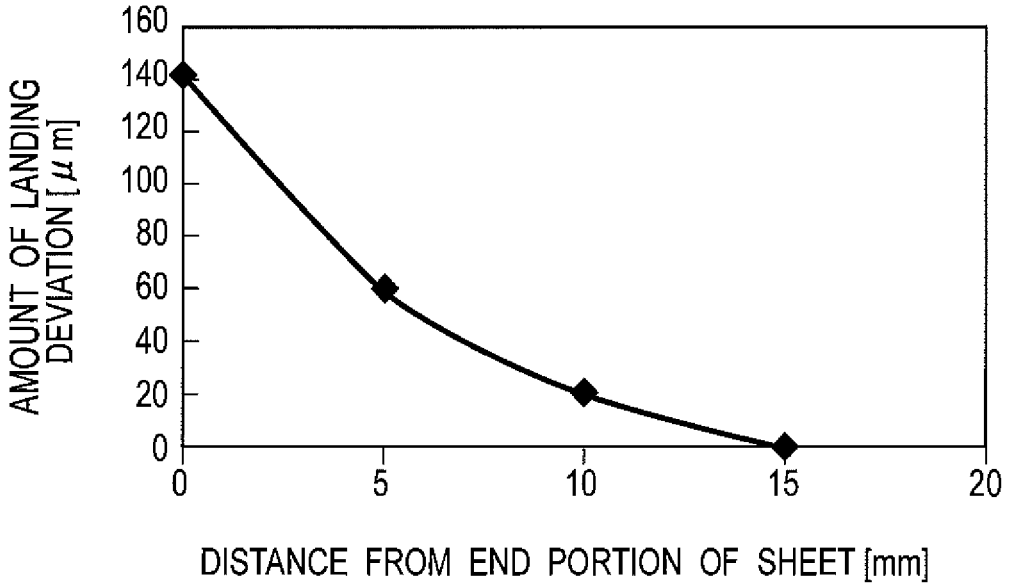
FIG. 14 is a graph showing a variation in the amount of landing deviation depending on a distance between an end portion of a print sheet and a position right below a nozzle in the profile data stored in the storage unit of FIG. 5.
Figure 15A:
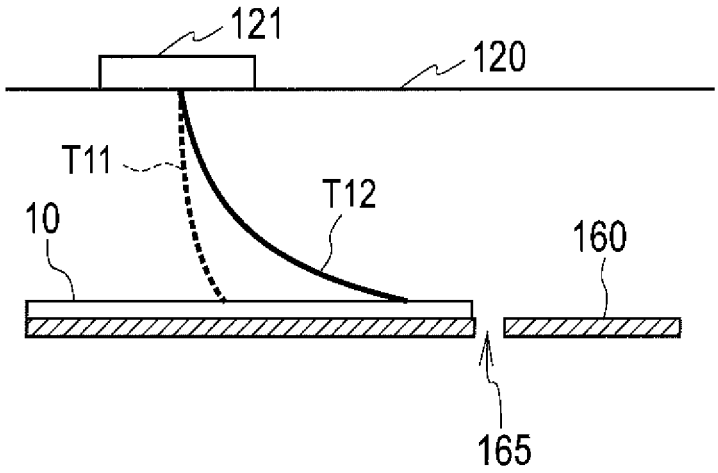
FIG. 15A is an explanation diagram showing trajectories of ink droplets from the nozzle of FIG. 10 before and after the correction to the ejection timing, in the case where the leading end area of a print sheet is located right below the nozzle.
Figure 15B:
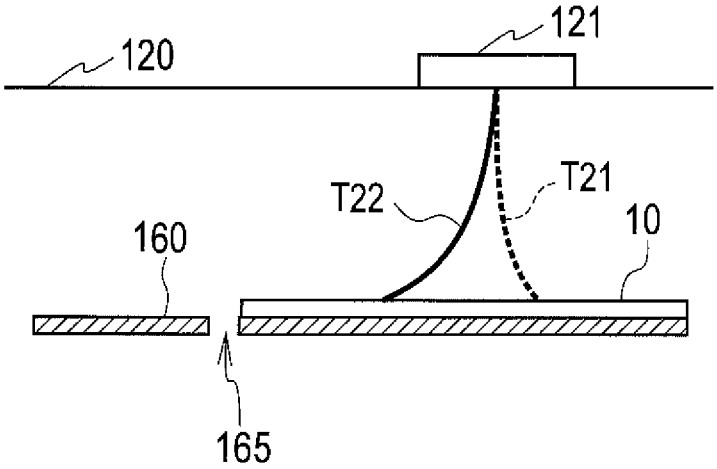
FIG. 15B is an explanation diagram showing trajectories of ink droplets from the nozzle of FIG. 10 before and after the correction to the ejection timing, in the case where the trailing end area of the print sheet is located right below the nozzle.
Figure 16A:
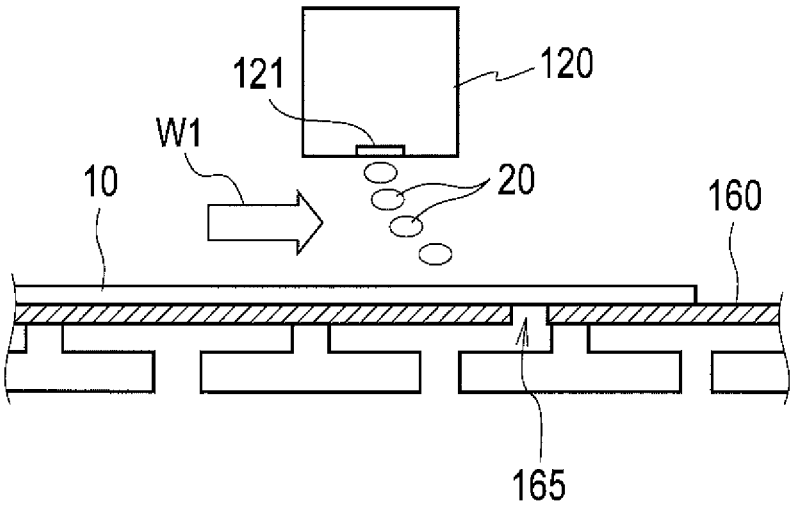
FIG. 16A is an explanation diagram showing a conveyance airstream generated when a print sheet is conveyed.
Figure 16B:
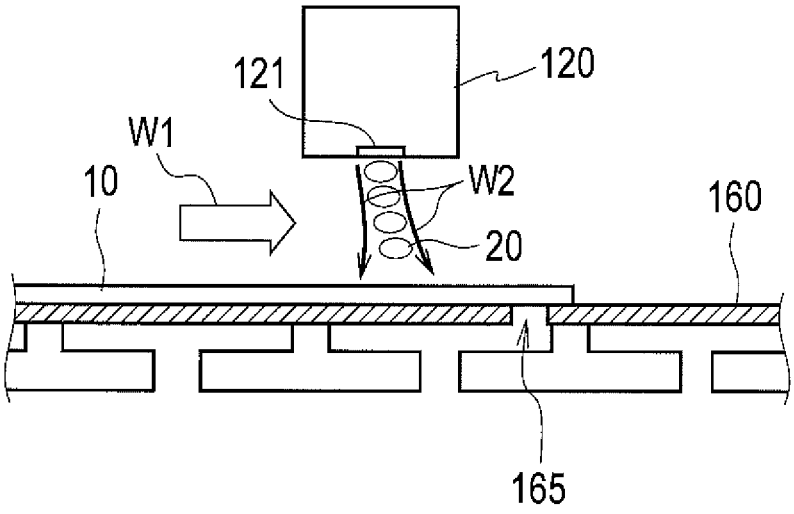
FIG. 16B is an explanation diagram showing a self-produced airstream generated when ink droplets are ejected from a nozzle.

Next, a description is given of the correction to the ejection timing due to the suction in the leading end area A1 and the trailing end area A2 of a print sheet 10. FIG. 14 is a graph showing a variation in the amount of landing deviation depending on a distance between the end portion of the print sheet 10 and a pixel right below a nozzle 121 according to the embodiment. FIG. 15A is an explanation diagram showing trajectories of ink droplets before and after the correction to the ejection timing due to the suction airstream W3 is made, in the case where the leading end area A1 of the print sheet 10 is located right below the nozzle 121. FIG. 15B is an explanation diagram showing trajectories of ink droplets before and after the correction to the ejection timing due to the suction airstream W3 is made, in the case where the trailing end area A2 of the print sheet 10 is located right below the nozzle 121.

In the embodiment, the storage unit 334 stores therein suction profile data, as shown in FIG. 14, indicating the amount of landing deviation caused by the influence of the suction airstream W3, with respect to the distance between an end portion of the print sheet 10 and the position P1 right below the nozzle 121.

The correction time calculation unit 333*d* calculates the distance between the end portion of the print sheet 10 and a pixel portion on which ink is to be ejected, upon receiving, from the correction judgment unit 333*c*, the result of judgment that correction due to the suction airstream W3 should be made. Then, the correction time calculation unit 333*d* obtains the amount of landing deviation associated with the calculated distance with reference to the suction profile data. After that, based on the amount of landing deviation thus obtained, the correction time calculation unit 333*d* first calculates, as a correction time Δt2, the amount of change to be made to the default correction amount, which the ejection control unit 333*b* uses for the ejection timing correction, the amount of change corresponding to the amount of variation in the amount of landing deviation due to the influence of the suction airstream W3.

The correction time Δt2 (unit: [μs]) is obtained by the following equation (EQ2):

$$\Delta t2=g(y))/v \quad \text{(EQ2)}$$

where g(y) indicates the amount of landing deviation corresponding to the distance y from the end portion of the print sheet 10, and v indicates the conveyance speed of the platen belt 160.

Then, the correction time calculation unit 333*d* calculates a correction time Δt for controlling the overall ejection timing with the influence of all of the conveyance airstream W1, the self-produced airstream W2, and the suction airstream W3 included. In this event, because the direction of the suction airstream W3 is different between the leading end area A1 and the trailing end area A2 of the print sheet 10, correction times Δt to be employed in these areas are respectively calculated.

To be more specific, in the leading end area A1 of the print sheet 10, ink droplets before the correction of the ejection timing are drifted downstream in the conveyance direction to a large extent as shown by a trajectory T12 of FIG. 15A because the conveyance airstream W1 and the suction airstream W3 flow in the same direction in this area. For this reason, the correction time calculation unit 333*d* obtains the correction time Δt from the following mathematical formula by using the correction time Δt1 obtained by the equation (EQ1) and the correction time Δt2 obtained by the equation (EQ2):

$$\Delta t=\Delta t1+\Delta t2.$$

The correction time calculation unit 333*d* transmits the correction time Δt to the ejection control unit 333*b* as correction data.

Based on the correction data (correction time Δt), the ejection control unit 333*b* performs correction such that the ejection timing at which the landing deviation occurs is moved forward or delayed so that ink droplets follow a trajectory T11 of FIG. 15A, which is a trajectory in the case of no suction airstream W3, and inputs the corrected signal to the ink head 120.

On the other hand, in the trailing end area A2 of the print sheet 10, ink droplets before the correction of the ejection timing are drifted upstream in the conveyance direction as shown by a trajectory T22 of FIG. 15B because the conveyance airstream W1 and the suction airstream W3 flow in opposite directions in this area. For this reason, the correction time calculation unit 333*d* obtains the correction time Δt from the following mathematical formula by using the correction time Δt1 obtained by the equation (EQ1) and the correction time Δt2 obtained by the equation (EQ2):

$$\Delta t=\Delta t1-\Delta t2.$$

The correction time calculation unit 333*d* transmits the correction time Δt to the ejection control unit 333*b* as correction data.

Based on the correction data (correction time Δt), the ejection control unit 333*b* performs correction such that the ejection timing at which the landing deviation occurs is moved forward or delayed so that ink droplets follow a trajectory T21 of FIG. 15B, which is a trajectory in the case of no suction airstream W3, and inputs the corrected signal to the ink head 120

Note that the correction judgment unit 333*c* selects each pixel from the leading end of the print sheet 10 and judges whether or not the pixel is the target of correction due to the suction airstream W3; however, the judgment processing on whether or not each pixel is the target of correction due to the suction airstream W3 may be omitted if it is judged, as a result of analysis of a print image, that the leading end area A1 and the trailing end area A2 are blank portions and therefore no print processing needs to be executed in these areas.

According to the second embodiment described above, in addition to the correction to the ink ejection timing to cope with the conveyance airstream W1 and the self-produced airstream W3, the landing deviation in the leading end area A1 and the trailing end area A2 of the print sheet 10 due to the influence of the suction airstream W3 can also be resolved. Thereby, every ejected droplet can be made to land at an appropriate position irrespective of whether the droplet is influenced by the self-produced airstream W2 and the suction airstream W3 constantly. As a result, the landing position accuracy can be improved, and a good image free from landing deviation can be provided.

Although the embodiments of the present invention have been described so far, these embodiments are merely examples for making the present invention easy to understand, and the present invention is not limited to the embodiments. The technical scope of the present invention includes not only the specific technical matters disclosed in the above embodiments, but also various modifications, changes, and alternative techniques that can be easily drawn therefrom.

This application claims priority based on Japanese Patent Application No. 2012-137695 filed on Jun. 19, 2012, the entire contents of which are incorporated herein by reference.

According to the present invention, the landing position accuracy can be improved, and a good image free from landing deviation can be formed by resolving the influence of the conveyance airstream and the self-produced airstream which are generated below the ink heads when ink droplets are ejected from the nozzles.

DESCRIPTION OF REFERENCE NUMERALS OR SYMBOLS

10 print sheet
100 inkjet recording apparatus
110 head unit
111 main-scanning flow path
112 sub-scanning flow path
120 ink head
120*a* side surface of ink head (its side surface on upstream side in conveyance direction, its side surface on downstream side in conveyance direction)
121 nozzle
122, 125 ink droplet
150 discharge port
160 platen belt
161 drive roller
162 driven roller
165 belt hole
240 register roller
330 processing unit
331 job data reception unit
332 drive control unit
332*a* head gap control unit
333 image processing unit
333*a* color conversion circuit
333*b* ejection control unit
333*c* correction judgment unit
333*d* correction time calculation unit
334 storage unit
335 sheet type acquisition unit
336 manipulation signal acquisition unit
350 drive unit
350*a* head gap adjustment unit
361 manipulation panel
500 head holder
500*a* head holder surface
500*b* attachment opening
510 stepped guide roller
510*a* upstream guide roller
510*b* downstream guide roller
620 platen plate
622 suction hole
650 suction fan
A1 leading end area
A2 trailing end area
A3 central area
D1 unit line
E1 certain nozzle
W1 conveyance airstream
W2 self-produced airstream
W3 suction airstream

What is claimed is:

1. An image formation apparatus configured to, when forming an image by ejecting ink from nozzles of an ink head onto a recording medium being conveyed on a conveyance path, control timing of ink ejection from each of the nozzles to cope with a conveyance airstream generated by the conveyance of the recording medium, the apparatus comprising an adjustment unit configured to adjust the ejection timing control on the basis of a self-produced airstream rate which is calculated based on a volume of ink ejected from the nozzle per unit time and indicates a generation rate of a self-produced airstream that causes the ink ejected from the nozzle to go straight against the conveyance airstream, a storage unit configured to store profile data in which the number of ink ejections from the nozzle per unit time and an amount of landing deviation of ink on the recording medium are associated with each other; and a judgment unit configured to judge whether or not the adjustment to the ejection timing control is needed, on the basis of a result of comparison between the volume of ink ejected from the nozzle per unit time and an ink ejection volume threshold corresponding to the self-produced airstream rate, wherein for the nozzle determined as needing the adjustment to the ejection timing control by the judgment unit, the adjustment unit calculates the number of ink ejections from the nozzle per unit time from the volume of ink ejected from the nozzle per unit time, determines an amount of landing deviation of ink corresponding to the calculated number of ink ejections on the basis of the profile data, and adjusts the ejection timing control using an adjustment content determined based on the self-produced airstream rate corresponding to the determined amount of landing deviation.

2. The image formation apparatus according to claim 1, wherein the judgment unit judges whether or not the nozzle has ejected at least one drop of ink to each of a predetermined number of pixels consecutively located on the recording medium at a position downstream of the nozzle in a conveyance direction of the recording medium, as the result of comparison between the volume of ink ejected per unit time and the threshold, and judges that the adjustment to the ejection timing control on the nozzle is needed if judging that the nozzle has ejected at least one drop of ink to each of the pixels.

3. The image formation apparatus according to claim 1, further comprising:

a sheet type acquisition unit configured to acquire information on a thickness of the recording medium; and a drive control unit configured to change a distance between the conveyance path and an ejection surface of the nozzle on the basis of the information on the thickness acquired by the sheet type acquisition unit, wherein the storage unit stores a plurality of the profile data corresponding to the distance, and the adjustment unit adjusts the ejection timing control using an adjustment content depending on the distance changed by the drive control unit.

4. The image formation apparatus according to claim 2, further comprising:

a sheet type acquisition unit configured to acquire information on a thickness of the recording medium; and a drive control unit configured to change a distance between the conveyance path and an ejection surface of the nozzle on the basis of the information on the thickness acquired by the sheet type acquisition unit, wherein the storage unit stores a plurality of the profile data corresponding to the distance, and the adjustment unit adjusts the ejection timing control using an adjustment content depending on the distance changed by the drive control unit.

5. The image formation apparatus according to claim 4, further comprising a suction unit configured to suck the recording medium to the conveyance path, wherein when the nozzle is located in an area within a predetermined distance from any of a leading end and a trailing end of the recording medium, the adjustment unit adjusts the ejection timing control depending on an airstream caused by the suction unit.

6. An image formation apparatus configured to, when forming an image by ejecting ink from nozzles of an ink head onto a recording medium being conveyed on a conveyance path, control timing of ink ejection from each of the nozzles to cope with a conveyance airstream generated by the conveyance of the recording medium, the apparatus comprising an adjustment unit configured to adjust the ejection timing control on the basis of a self-produced airstream rate which is calculated based on a volume of ink ejected from the nozzle per unit time and indicates a generation rate of a self-produced airstream that causes the ink ejected from the nozzle to go straight against the conveyance airstream, a suction unit configured to suck the recording medium to the conveyance path, wherein when the nozzle is located in an area within a predetermined distance from any of a leading end and a trailing end of the recording medium, the adjustment unit adjusts the ejection timing control depending on an airstream caused by the suction unit.

* * * * *